US006247398B1

(12) United States Patent
Kayser et al.

(10) Patent No.: US 6,247,398 B1
(45) Date of Patent: Jun. 19, 2001

(54) CALENDER ARRANGEMENT FOR MANUFACTURING A PAPER WEB

(75) Inventors: Franz Kayser, Geldern; Joachim Hinz, Kempen; Mathias Helmus, Tönisvorst; Gerhard Stock, Krefeld, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/353,339

(22) Filed: Jul. 15, 1999

(30) Foreign Application Priority Data

Jul. 16, 1998 (DE) ..... 198 32 065

(51) Int. Cl.[7] ..... D21G 1/00

(52) U.S. Cl. ..... 100/76; 100/162 R; 100/162 B; 100/304; 248/679

(58) Field of Search ..... 100/161–167, 100/76, 304; 72/232; 248/638, 679

(56) References Cited

U.S. PATENT DOCUMENTS

| | | | | |
|---|---|---|---|---|
| 3,066,876 | * | 12/1962 | Verdier | 100/161 |
| 3,154,008 | | 10/1964 | Hurter . | |
| 3,515,637 | * | 6/1970 | Reynolds et al. | 100/164 |
| 4,200,045 | * | 4/1980 | Toropainen | 100/162 B |
| 4,211,165 | * | 7/1980 | Schill | 100/162 R |
| 4,303,220 | * | 12/1981 | Gallasch | 248/679 |
| 4,498,383 | * | 2/1985 | Pav et al. | 100/162 B |
| 5,655,442 | * | 8/1997 | Conrad et al. | 100/161 |

FOREIGN PATENT DOCUMENTS

| | | | | |
|---|---|---|---|---|
| 2603485 | * | 8/1977 | (DE) | 100/161 |
| 19534911 | | 9/1996 | (DE) . | |
| 19633671 | | 3/1998 | (DE) . | |
| 0794285 | * | 3/1996 | (EP) . | |
| 2136578 | * | 12/1972 | (FR) . | |
| 137357 | * | 1/1920 | (GB) | 100/161 |
| 202753 | * | 8/1923 | (GB) | 100/162 R |
| 921296 | | 3/1963 | (GB) . | |
| 2158116 | | 11/1985 | (GB) . | |
| 730920 | * | 5/1980 | (SU) . | |

* cited by examiner

*Primary Examiner*—Stephen F. Gerrity
(74) *Attorney, Agent, or Firm*—Greenblum & Bernstein, P.L.C.

(57) ABSTRACT

A calender for manufacturing a material web. A frame is supported at the top and bottom. At least five rolls are mounted on the frame such that axes of the rolls lie in a substantially common plane extending substantially parallel to the frame. The common plane extends at an acute angle relative to a horizontal plane.

26 Claims, 2 Drawing Sheets

CALENDER ARRANGEMENT FOR MANUFACTURING A PAPER WEB

CROSS-REFERENCE TO RELATED APPLICATIONS

The present application claims priority under 35 U.S.C. § 119 of German Patent Application No. 198 32 065.5, filed on Jul. 16, 1999, the disclosure of which is expressly incorporated by reference herein in its entirety.

BACKGROUND OF THE INVENTION

1. Field of the Invention

The present invention relates to a calender arrangement for manufacturing a web of paper or similar material. More particularly, the present invention is directed to a calender having a frame supported from below and at least live rolls mounted oil it, whose axes lie in a common plane running roughly parallel to the frame.

2. Discussion of Background Information

In a known calender arrangement of this type, such as DE 196 33 671 A1, two 5-roll stacks are arranged on a frame, one above the other, in a common vertical plane. The frame rests with its bottom on a footing.

DE 195 34 911 C2 shows an 8-roll stack whose center plane is inclined approximately 60° relative to the horizontal.

SUMMARY OF THE INVENTION

The present invention provides a calender with a frame that minimizes vibrations in the calender.

The present invention has a common plane parallel to a frame that extends at an angle relative to the horizontal. The angular inclination of the frame permits support at both the bottom and the top. With a 2-point support, the tendency to vibrate is significantly reduced compared to a frame which is supported only at the bottom. Moreover the frame can be produced more easily and less expensively.

Preferably, the frame is supported both at the top and at the bottom on bearing surfaces solidly attached to a building. Relatively strong forces can be dissipated by these bearing surfaces.

Preferably, the bearing surfaces extend horizontally. Thus, vertical forces, which are the most common, can be readily dissipated.

Preferably, the upper and lower bearing surfaces are formed by concrete footings (a pillar, a pedestal, or the like). Such concrete footings can be provided as part of the structure of the building in a significantly more cost effective manner than as supports installed on the frame.

An upper support surface is preferably designed on a support foot which is arranged on the frame near its upper end. A lower support surface is also preferably constructed directly on the frame.

Preferably the common plane extends at an angle of approximately 30 to 60° relative to the horizontal plane of the calender, and particularly approximately 45°. With such an angle, the height of the frame is less than a 10-roll calender having rolls vertically arranged one above the other, and the length is shorter than a calender having two 5-roll stacks arranged parallel to each other.

The frame can be arranged between the last drying cylinder and a winder, which are located at roughly the same height. By the angular inclinations the height of the frame is reduced enough such that the web can run between the drying cylinder and the calender, as well as between the calender and a winder, with a slight gradient. This in turn facilitates the feeding of the web, which is beneficial for online operation.

Preferably, the rolls are arranged on the inclined top of the frame. At least one roll is preferably displaceable at a right angle to the plane by an adjustment device. The roll can be moved out a relatively short distance such that it can be gripped directly by a crane and removed.

The present invention is directed to a calender for manufacturing a material web. A frame is supported at the top and bottom. At least five rolls are mounted on the frame such that axes of the rolls lie in a substantially common plane extending substantially parallel to the frame. The common plane extends at an acute angle relative to a horizontal plane.

According to features of the above embodiment, both the top and bottom of the frame are supported by bearing surfaces fixed to a floor. The bearing surfaces extend horizontally, and are formed by concrete footings. The frame has an upper support surfaces formed on a support foot, which is arranged near an upper end of the frame. A lower support surface is constructed directly on the frame.

The acute angle of the above embodiment preferably extends approximately 30 to 60° relative to the horizontal plane, and particularly approximately 45° relative to the horizontal plane.

Preferably, the frame is disposed between a drying cylinder and a winder, which are located at approximately the same height.

Also preferably, the at least five rolls are arranged on the top of the frame, and at least one of the at least five rolls is displaceable at a right angle to the common plane by an adjustment device.

Other exemplary embodiments and advantages of the present invention may be ascertained by reviewing, the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention in which like numerals represent like elements throughout the several views of the drawings, and wherein.

DETAILED DESCRIPTION OF THE EXEMPLARY EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
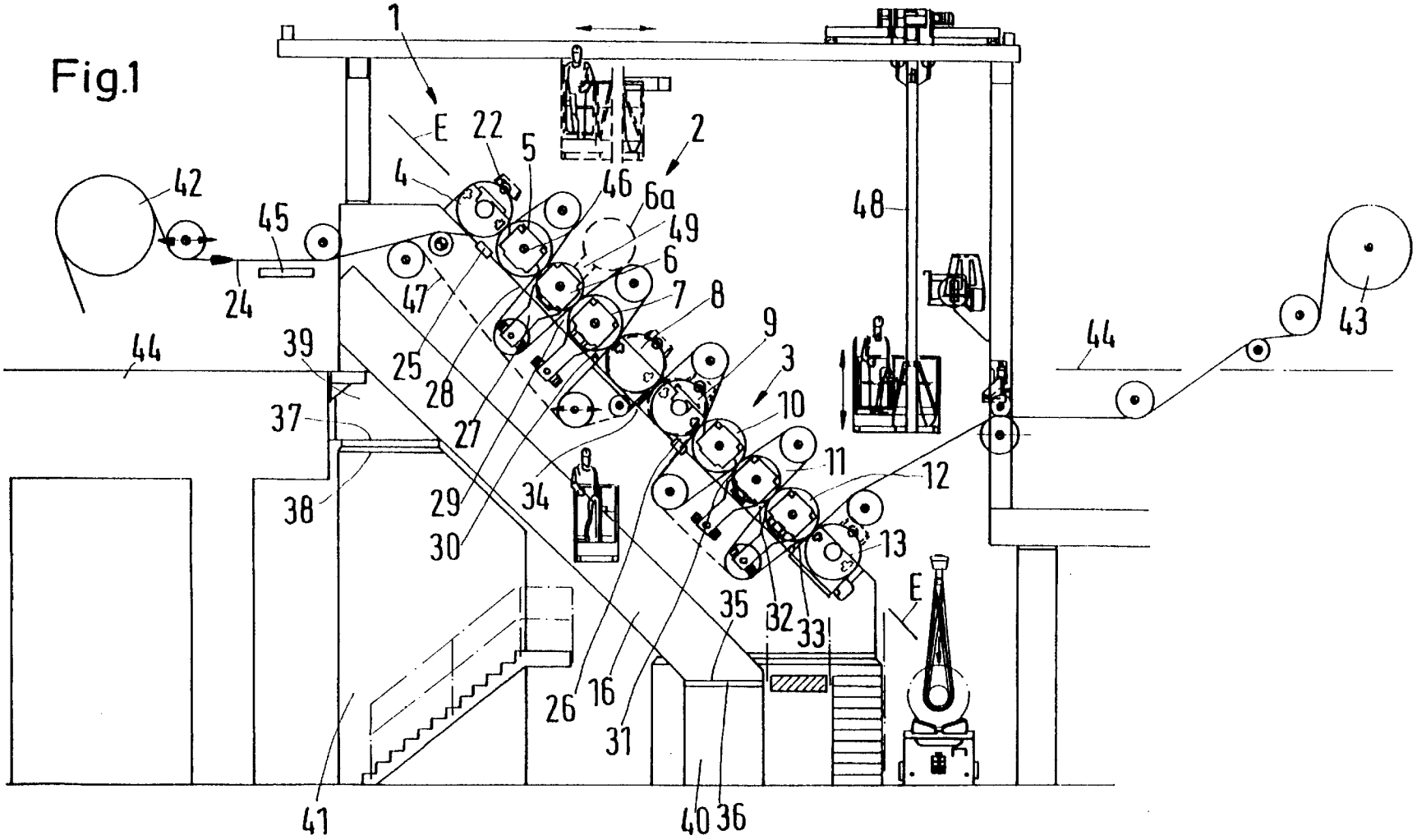
FIG. 1 is a schematic side view of a calender according to the invention.

Referring now to FIG. 1, a calender 1 has an upper 5-roll stack 2 and a lower 5-roll stack 3. The upper roll stack 2 includes an upper roll 4, three intermediate rolls 5, 6, and 7, and a lower roll 8. The lower roll stack 3 includes an upper roll 9, three intermediate rolls 10, 11, and 12, and a lower roll 13.

Figure 2:
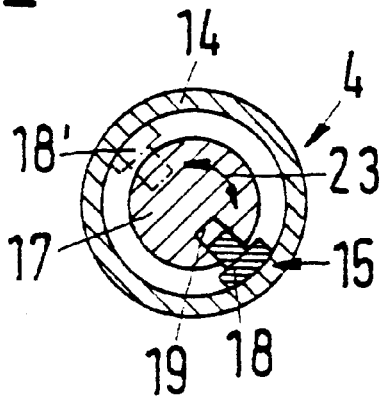
FIG. 2 is a cross-sectional view through a central region of a sag compensation roll.
Figure 3:
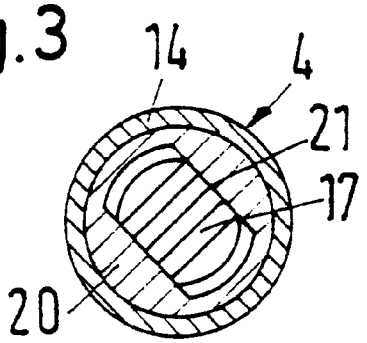
FIG. 3 is a cross-sectional view through an end region of a sag compensation roll.
Figure 4:
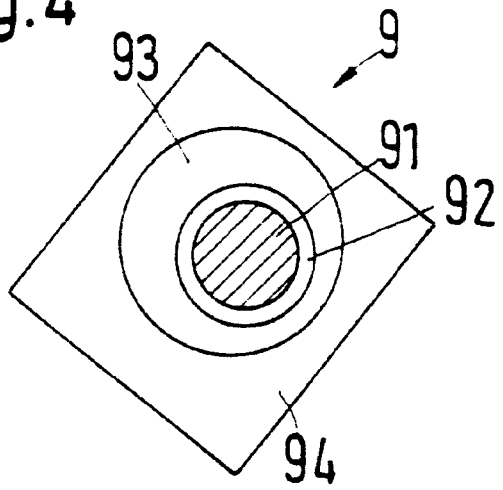
FIG. 4 is a schematic depiction of the mounting of the bracket of a sag compensation roll.

The upper and lower rolls 4, 8, 9, and 13 are sag compensation rolls of the sleeve lift type. The rolls have the same structure such that one spare roll suffices for all four end rolls. Referring now to FIGS. 2 and 3, each sag compensation roll 4 has a sleeve 14, which is supported by a sag, compensation device 15 on a bracket 17 fixedly mounted on a frame 16 during operation. The sag compensation device 15 includes a group of hydrostatic support elements 18 which are supplied in a known fashion via a pressure chamber 19 with a pressure medium such that the sag compensation device 15 also serves as a loading device. The roll sleeve 15 is mounted at its ends on a bearing ring 20, which is displaceable over its entire length in a lift direction on a lifting guide 21. The bracket 17 is also rotatable by an angle of 180° by an adjustment device 22 along arrow 23 in FIG. 2. The operational direction of the sag compensation device 15 thus alternatively points in opposite directions, as is indicated by the group of support elements 18' depicted by dot-dash lines.

The upper intermediate rolls 5 and 10 are mounted fixedly on the frame 16. When, in the associated upper rolls 4 and 9, the sag compensation device 15 has the position depicted in FIG. 2, the paper web 24 can be processed between nips 25 and 26 in the travel direction of the upper roll stack 2 or of the lower roll stack 3 with a very high line load and corresponding high compressive stress.

The intermediate rolls 6, 7, 11, and 12 are each mounted on a lever 27, which pivots around a frame-fixed pivot axis. When the sat, compensation devices 15 of the lower rolls 8 and 13 are in the position depicted by hatch marks in FIG. 2, the nips 28, 29, and 30 of the upper roll stack 2 and the nips 31, 32, and 33 of the lower roll stack 3 are loaded accordingly. The magnitude of the load is independent of nips 25 or 26. Consequently, there are four sections in which the paper web 24 can be processed differently, such that many different paper qualities can be produced.

Between the two roll stacks 2 and 3 an additional open nip 34 remains during normal operation, through which the paper web 24 passes unhindered. One side of the web is glazed (preferably in the upper roll stack 2), and the other side is glazed (preferably in the lower roll stack 3).

The upper and lower rolls 4, 8, 9, and 13 as well as the central intermediate rolls 7 and 11 are elastic rolls, whereas the remaining intermediate rolls 5, 7, 10, and 12 are heated hard rolls. However other combinations are also possible. For example, the upper and lower rolls can be hard.

The distance between the two sag compensation rolls 9 and 10 is so small that the additional nip 34 can be closed by, for example, by approximately 30 to 40 mm using the roll hub. The sag compensation devices 15 of the two end rolls 8 and 9 rotate toward each other using the adjustment device 22, and then add the pressure medium with an appropriate pressure. With this additional nip 34, matt finishing can be performed, since the two sag, compensation rolls 8 and 9 have an elastic coating. An additional paper processing feature is thus provided without significant additional expense.

If the additional open nip 34 is large, such that the sleeve lift is unable to close it, the bracket 91 of the upper roll 9 can be mounted in a spherical cap 92 which is in turn mounted on a cam disk 93. The latter is pivotable by 180° together with the bracket 91 by the adjustment device 22 in the bearing 94. Thus, the additional open nip 34 can be, for example, moved 80 mm. This also opens nips 28 and 29.

The axes of the rolls 4 through 13 lie roughly in a common plane E, which is inclined 45° relative to the horizontal. Accordingly, the frame 16 also has an oblique path. Consequently, it can be supported at two points, i.e., with a lower support surface 35 on a bearing surface 36 solidly attached to the building and with an upper support surface 37 on an upper bearing surface 38 solidly attached to the building. The support surface 37 is located on a foot 39 which is installed on the frame 16 near its upper end. The bearing surfaces 36 and 38 extend horizontally and are each designed on a concrete footing or base 40 or 41, respectively. Thus, the frame 16 is largely insensitive to vibrations. The frame 16 can be produced with lower stability than the prior art, and is thus less expensive.

The calender 1 can function in an online paper manufacturing operation. It is preferably located between the last drying roll 42 of a drying section of a paper machine and a winder 43, for example, a roll cutter and winder. The drying roll 42 and winder 43 are located at roughly the same height and above a working plane 44, through which the calender 1 passes. Thus, the paper web 24 has a relatively slightly rising path between the drying roll 42 and the entry into the calender 1 as well as between the outlet of the calender 1 and the winder 43. This facilitates the introduction of the paper web in online operation. The same advantage also results when the paper web is introduced from the drying roll 42 down into the calender 1 and exits upward to the winder 43.

A web feeding device 45, only outlined in FIG. 1, which operates, for example, by rope clamping, guides the front end of the web through nips 25–33 of the two roll stacks 2 and 3, and the additional nip 34. Consequently, one feeding process is sufficient for both roll stacks. The feeding motion is supported in that all rolls of the calender and the associated guide rolls have one common drive 46. The paper processing thus depends on which of the above-mentioned nips are closed. A second web feeding device 47, by which only the additional nip 34 is supplied, is depicted by broken lines. During matt finishing of a web thus introduced, other rolls can be repaired or replaced. By way of example, semi-matt operation occurs when only the upper nip 25 is used.

The precise incline of the frame 16 depends on the local conditions. Values which deviate from 45° by approximately plus or minus 10° still fall within the preferred range.

The angular inclination with the roll stacks arranged above has the additional advantage of the rolls being more readily accessible for exchange. These rolls are removable and insertable with a crane 48 and corresponding crane control. In particular, the mounting of the roll to be exchanged can be pulled out by means of a hydraulic adjustment device 49 along a guide perpendicular to the plane E, as shown with broken lines in FIG. 1. The piston of a hydraulic cylinder extending along the lever 27 is favored as an adjustment device 49. In the outer position, the crane 48 can grasp the roll ends directly and remove the roll vertically.

It is noted that the foregoing examples have been provided merely for the purpose of explanation and are in no way to be construed as limiting of the present invention.

While the present invention has been described with reference to certain embodiments it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments the present invention is not intended to be limited to the particulars disclosed herein; rather, the present invention extends to all functionally equivalent structures, methods and uses, such as are within the scope of the appended claims.

What is claimed is:

1. A calender for manufacturing a material web, comprising:

a frame having a top and a bottom and being supported at the top and bottom;

at least five rolls mounted on the frame such that axes of the rolls lie in a substantially common plane extending substantially parallel to the frame; and the substantially common plane extends at an acute angle relative to a horizontal plane, wherein both the top and bottom of the frame are supported by bearing surfaces fixed to a floor.

2. The calender of claim 1, wherein the bearing surfaces are one of arranged horizontally and arranged parallel to the horizontal plane.

3. The calender of claim 1, wherein the bearing surfaces comprise concrete footings.

4. The calender of claim 1, wherein the bearing surface supporting the top of the frame is disposed at a greater distance from the floor than the bearing surface supporting the bottom of the frame.

5. The calender of claim 1, wherein the top of the frame is disposed at a greater distance from the floor than the bottom of the frame.

6. The calender of claim 1, wherein the top of the frame is arranged to be higher than the bottom of the frame relative to the horizontal plane.

7. The calender of claim 1, wherein a lower support surface is constructed directly on the frame.

8. The calender of claim 1, wherein the acute angle extends approximately 30° to 60° relative to the horizontal plane.

9. The calender of claim 8, wherein the acute angle is approximately 45° relative to the horizontal plane.

10. The calender of claim 1, wherein the frame is disposed between a drying cylinder and a winder.

11. The calender of claim 1, wherein the frame is disposed between a drying cylinder and a winder, which are located at approximately the same height.

12. The calender of claim 1, wherein the at least five rolls are arranged on the top of the frame, and wherein at least one of the at least five rolls is displaceable at a right angle to the common plane by an adjustment device.

13. The calender of claim 1, wherein at least one of the at least five rolls comprises a sag compensation roll.

14. The calender of claim 1, further comprising a crane.

15. A calender for manufacturing a material web, comprising:

a frame comprising a top and a bottom;

the top of the frame being supported on a first bearing surface fixed to a floor;

the bottom of the frame being, supported on a second bearing surface fixed to a floor;

at least five rolls mounted on the frame such that axes of the rolls lie in a substantially common plane extending substantially parallel to the frame; and the substantially common plane extending at an acute angle relative to a horizontal plane, wherein the first and second bearing surfaces supporting the frame are adapted to minimize vibrations in the calender.

16. The calender of claim 15, wherein the bearing surfaces are one of arranged horizontally and arranged parallel to the horizontal plane.

17. The calender of claim 15, wherein the first and second bearing surfaces comprise concrete footings.

18. The calender of claim 15, wherein the top of the frame is arranged to be higher than the bottom of the frame relative to the horizontal plane.

19. The calender of claim 15, wherein the acute angle extends approximately 30° to 60° relative to the horizontal plane.

20. The calender of claim 15, wherein the frame is disposed between a drying cylinder and a winder.

21. The calender of claim 15, wherein at least one of the at least five rolls comprises a sag compensation roll.

22. The calender of claim 15, further comprising a crane.

23. A calender for manufacturing a material web, comprising:

a frame comprising a first end and a second end;

the first end of the frame being supported on a first concrete support;

the second end of the frame being supported on a second concrete support;

at least five rolls mounted on the frame such that axes of the rolls lie in a substantially common plane extending substantially parallel to the frame; and the substantially common plane extending at an acute angle relative to a horizontal plane.

24. The calender of claim 23, wherein at least one of the at least five rolls comprises a sag compensation roll.

25. The calender of claim 23, further comprising a crane.

26. A calender for manufacturing a material web, comprising:

a frame comprising a first end and a second end;

the first end of the frame being supported on a first bearing support;

the second end of the frame being supported on a second bearing support;

each of the first and second bearing Supports being attached to a building floor, at least five rolls mounted on the flame such that axes of the rolls lie in a substantially common plane extending substantially parallel to the frame; and the substantially common plane extending at an acute angle relative to a horizontal plane, wherein the first and second bearing supports supporting the frame are adapted to minimize vibrations in the calender.

* * * * *